US011699538B1

(12) United States Patent
Sumner et al.

(10) Patent No.: US 11,699,538 B1
(45) Date of Patent: Jul. 11, 2023

(54) HIGH-VOLTAGE ELECTRICAL CABLE WITH MIXED CONDUCTORS

(71) Applicant: Aptiv Technologies Limited, St. Michael (BB)

(72) Inventors: Randall Sumner, New Wilmington, PA (US); John Kightlinger, Canfield, OH (US); George Drew, Cortland, OH (US); Gina Sacco, Warren, OH (US); Jonathon D. Weidner, Conneautville, PA (US)

(73) Assignee: APTIV TECHNOLOGIES LIMITED, St. Michael (BB)

( * ) Notice: Subject to any disclaimer, the term of this patent is extended or adjusted under 35 U.S.C. 154(b) by 0 days.

(21) Appl. No.: 17/725,094

(22) Filed: Apr. 20, 2022

(51) Int. Cl.

| | |
|---|---|
| ***H01B 9/00*** | (2006.01) |
| ***H01B 1/02*** | (2006.01) |
| ***H01B 13/02*** | (2006.01) |
| ***H01B 7/00*** | (2006.01) |

(52) U.S. Cl.
CPC ..... *H01B 9/00* (2013.01); *H01B 1/023* (2013.01); *H01B 1/026* (2013.01); *H01B 7/0009* (2013.01); *H01B 13/02* (2013.01)

(58) Field of Classification Search
USPC ..... 174/108
See application file for complete search history.

(56) References Cited

U.S. PATENT DOCUMENTS 1,201,290 A * 10/1916 Harrison ..... 57/216
1,680,679 A * 8/1928 Hayman ..... H01B 9/00 174/116
1,746,390 A * 2/1930 Frederickson ..... H01B 9/00 174/116
2,480,280 A * 8/1949 Bergan ..... H01R 43/058 219/118
2,584,027 A * 1/1952 Kendrick ..... H01B 7/046 174/128.1
3,681,514 A * 8/1972 Rhoades ..... H01B 7/226 174/115
3,683,103 A * 8/1972 Mancino ..... H01B 7/0009 174/126.2
3,692,924 A * 9/1972 Nye ..... H01H 85/0241 174/120 SR
3,758,704 A * 9/1973 Naud ..... H01J 31/065 57/212
10,902,966 B2 1/2021 Kaneko
2010/0096162 A1* 4/2010 Cerra ..... H01B 7/0009 174/126.2

(Continued)

FOREIGN PATENT DOCUMENTS

FR 2990048 A1 11/2013
FR 3009126 A1 1/2015
JP 2004050204 A * 2/2004

*Primary Examiner* — Krystal Robinson
(74) *Attorney, Agent, or Firm* — Billion & Armitage

(57) ABSTRACT

A high-voltage electrical cable assembly includes a central wire strand containing at least seven wires formed of a first alloy and a plurality of outer wire strands twisted around the central strand. At least one outer wire strand of the plurality of outer wire strands contains at least seven wires formed of a second alloy different from the first alloy. There is an electrochemical potential of about 2 volts between the first alloy and the second alloy. A method of assembling a high-voltage electrical cable assembly is also presented herein.

16 Claims, 5 Drawing Sheets

(56) References Cited

U.S. PATENT DOCUMENTS

| | | | | |
|---|---|---|---|---|
| 2010/0263911 | A1* | 10/2010 | Watanabe | C23C 10/28<br>174/126.2 |
| 2011/0036614 | A1* | 2/2011 | Otsuka | C22C 21/00<br>156/50 |
| 2014/0327444 | A1* | 11/2014 | Aparicio Rollan | G01R 31/364<br>324/426 |
| 2016/0064117 | A1* | 3/2016 | Romero | A61M 60/422<br>174/113 C |

* cited by examiner

HIGH-VOLTAGE ELECTRICAL CABLE WITH MIXED CONDUCTORS

CROSS-REFERENCE TO RELATED APPLICATION

This disclosure is directed to a high-voltage electrical cable with mixed, e.g., aluminum and copper, conductors.

BACKGROUND

Currently most high voltage electrical cable used in automobiles today use a copper-based conductor for most circuits. As more power is needed the current flowing through the conductor also increases. The cross-sectional area of the conductors must also increase to safely carry the current. The increase in cross sectional area drives a significant increase of the weight of the copper-based conductor. A current alternative to reduce weight is to use an aluminum-based conductor in place of the copper-based conductor. The aluminum-based conductor option reduces the weight of the connector significantly but increases the diameter of the electrical cable because the aluminum-based conductor requires a larger cross-sectional area to carry the same current as the copper-based conductor. The aluminum-based conductor is also more difficult to ultrasonically weld to a terminal than the copper-based conductor. Therefore, a high-voltage electrical cable with a lower weight than a copper-based conductor and a smaller-cross-sectional area than an aluminum-based conductor remains desired.

SUMMARY

According to one or more aspects of the present disclosure, a high-voltage electrical cable assembly includes a central wire strand containing at least seven wires formed of a first alloy and a plurality of outer wire strands twisted around the central strand. At least one outer wire strand of the plurality of outer wire strands contains at least seven wires formed of a second alloy different from the first alloy. There is an electrochemical potential of about 2 volts between the first alloy and the second alloy.

In one or more embodiments of the high-voltage electrical cable assembly according to the previous paragraph, the first alloy is a copper based alloy and the second alloy is an aluminum based alloy.

In one or more embodiments of the high-voltage electrical cable assembly according to any one of the previous paragraphs, the first alloy is an aluminum based alloy and the second alloy is a copper based alloy.

In one or more embodiments of the high-voltage electrical cable assembly according to any one of the previous paragraphs, the plurality of outer wire strands is formed of the second alloy.

In one or more embodiments of the at least seven wires formed of the first alloy are uncoated.

In one or more embodiments of the at least seven wires formed of the second alloy are uncoated.

In one or more embodiments of the high-voltage electrical cable assembly according to any one of the previous paragraphs, a first half of the plurality of outer wire strands is formed of the first alloy and a second half of the plurality of outer wire strands is formed of the second alloy.

In one or more embodiments of the high-voltage electrical cable assembly according to any one of the previous paragraphs, the high-voltage electrical cable assembly is disposed within a housing sealed against environmental contaminants.

In one or more embodiments of the high-voltage electrical cable assembly according to any one of the previous paragraphs, the high-voltage electrical cable assembly further includes an electrical terminal. The central wire strand and the plurality of outer wire strands are ultrasonically welded to the electrical terminal.

In one or more embodiments of the high-voltage electrical cable assembly according to any one of the previous paragraphs, the central wire strand and the plurality of outer wire strands are ultrasonically welded to each other.

According to one or more aspects of the present disclosure, a method of assembling a high-voltage electrical cable assembly includes providing a central wire strand containing at least seven wires formed of a first alloy and twisting a plurality of outer wire strands twisted around the central strand. At least one outer wire strand of the plurality of outer wire strands contains at least seven wires formed of a second alloy different from the first alloy. There is an electrochemical potential of about 2 volts between the first alloy and the second alloy.

In one or more embodiments of the method according to the previous paragraph, the first alloy is a copper based alloy and the second alloy is an aluminum based alloy.

In one or more embodiments of the high-voltage electrical cable assembly according to any one of the previous paragraphs, the plurality of outer wire strands is formed of the second alloy.

In one or more embodiments of the high-voltage electrical cable assembly according to any one of the previous paragraphs, the plurality of outer wire strands is formed of the second alloy.

In one or more embodiments of the high-voltage electrical cable assembly according to any one of the previous paragraphs, the method further includes disposing the high-voltage electrical cable assembly within a housing sealed against environmental contaminants.

In one or more embodiments of the high-voltage electrical cable assembly according to any one of the previous paragraphs, the method further includes attaching an electrical terminal to the central wire strand and the plurality of outer wire strands.

In one or more embodiments of the high-voltage electrical cable assembly according to the previous paragraph, the step of attaching the electrical terminal to the central wire strand and the plurality of outer wire strands is performed using an ultrasonic welding process.

In one or more embodiments of the high-voltage electrical cable assembly according to any one of the previous paragraphs, the method further includes welding the central wire strand and the plurality of outer wire strands to each other.

In one or more embodiments of the high-voltage electrical cable assembly according to the previous paragraph, the step of welding the central wire strand and the plurality of outer wire strands to each other is performed using an ultrasonic welding process.

BRIEF DESCRIPTION OF THE DRAWINGS

The present invention will now be described, by way of example with reference to the accompanying drawings, in which.

Similar elements in the various illustrated embodiments share the last two digits of the reference numbers.

DETAILED DESCRIPTION

Non-limiting examples of high voltage electrical cable assemblies and a method of assembling such high-voltage electrical cable assemblies are presented herein. As used herein, a high-voltage electrical cable assembly refers to an electrical cable assembly capable of safely conducting 50 or more volts at 50 or more amperes. The wire cable includes a plurality of wires arranged in strands which are bundles of individual wires. In the illustrated non-limiting examples, each strand contains at least seven wires; six outer wires are helically twisted around a central wire in a manner similar to a wire rope. The plurality of wires in each strand is uncoated. As used herein, the definition of "uncoated" is no metallic plating, polymer coating, oil coating, wax coating, or any other coating that protects the wires from electrolytes that could support galvanic corrosion is applied to or found on the surfaces of the wires. According to this definition, only naturally occurring oxides or contaminants from the environment or manufacturing process are found on the surfaces of the wires.

The electrical cable has a central wire stand that is surrounded by a plurality of at least 6 outer wire strands that are helically twisted around the central strand. The wires in the central strand are formed of a first electrical alloy and the wires in at least one of the outer wire strands are formed of a second, different, alloy. In one example of the electrical cable assembly, the central stand is made of wires formed of a copper-based alloy and at least one of the outer wire strands is made of wires formed of an aluminum-based alloy. In another example of the electrical cable assembly, the central stand is made of wires formed of an aluminum-based alloy and at least one of the outer wire strands is made of wires formed of a copper-based alloy. An electrochemical potential of about 2 volts exists between the first alloy and the second alloy. As used herein "about 2 volts" means 2±0.2 volts, i.e., ±10%.

Figure 1:
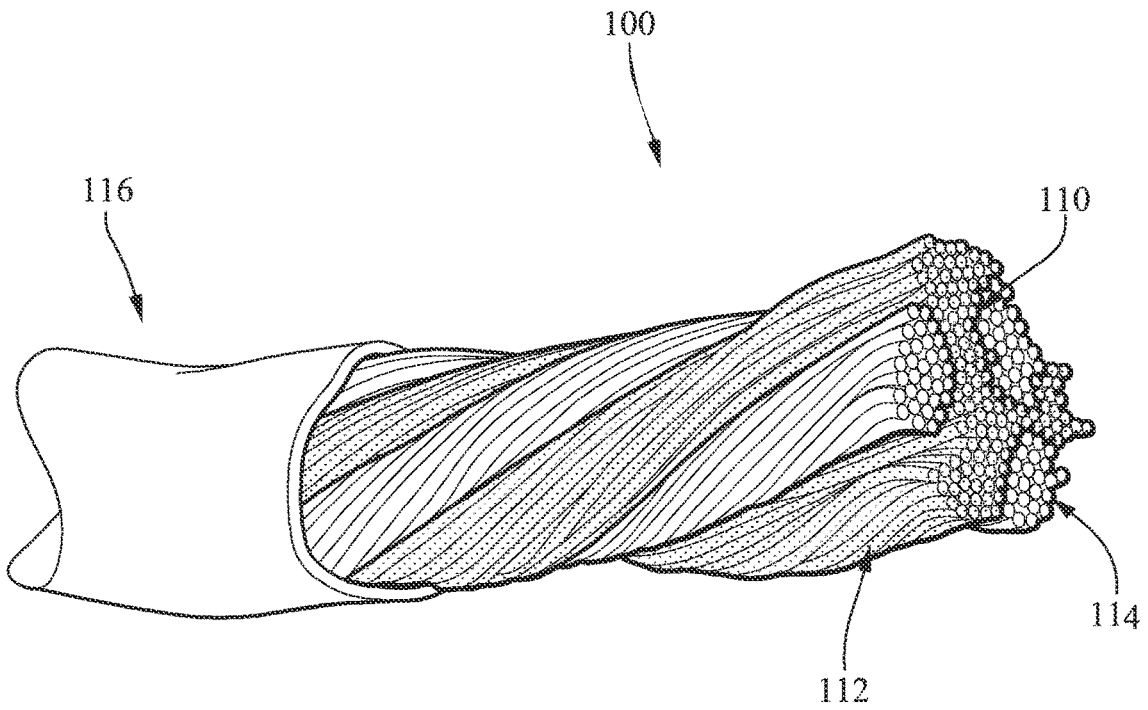
FIG. 1 is a perspective view of an electrical cable assembly according to some embodiments.
Figure 2:
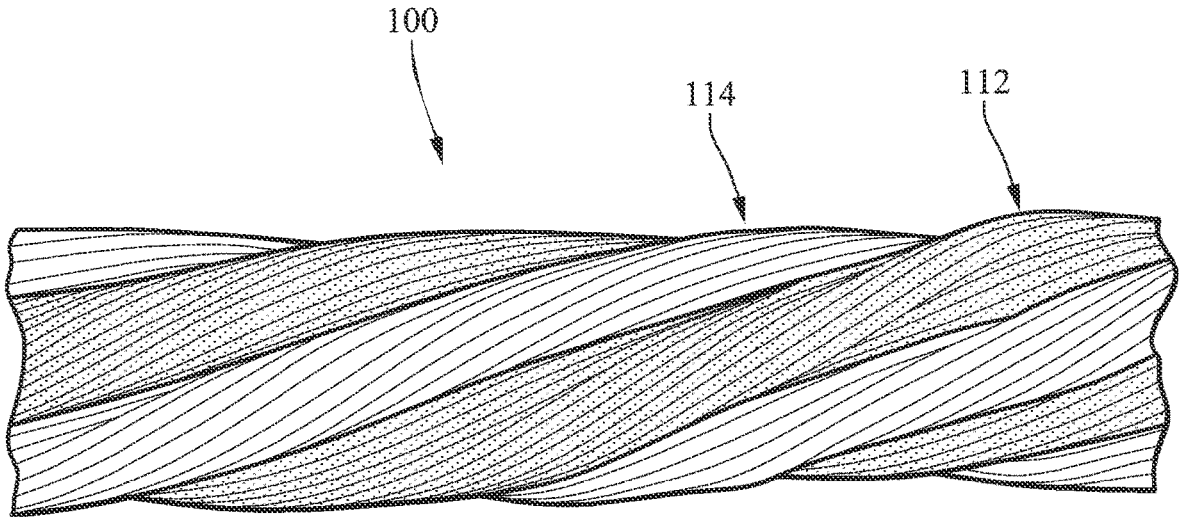
FIG. 2 is a side view of the electrical cable assembly of FIG. 1 according to some embodiments.
Figure 3:
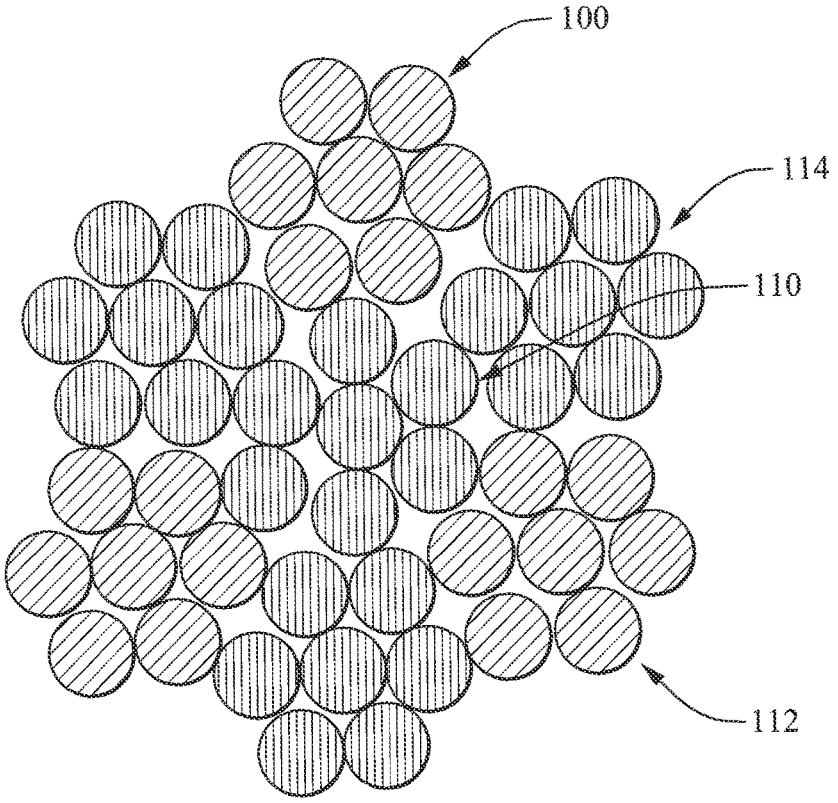
FIG. 3 is an end view of the electrical cable assembly of FIG. 1 according to some embodiments.
Figure 4:
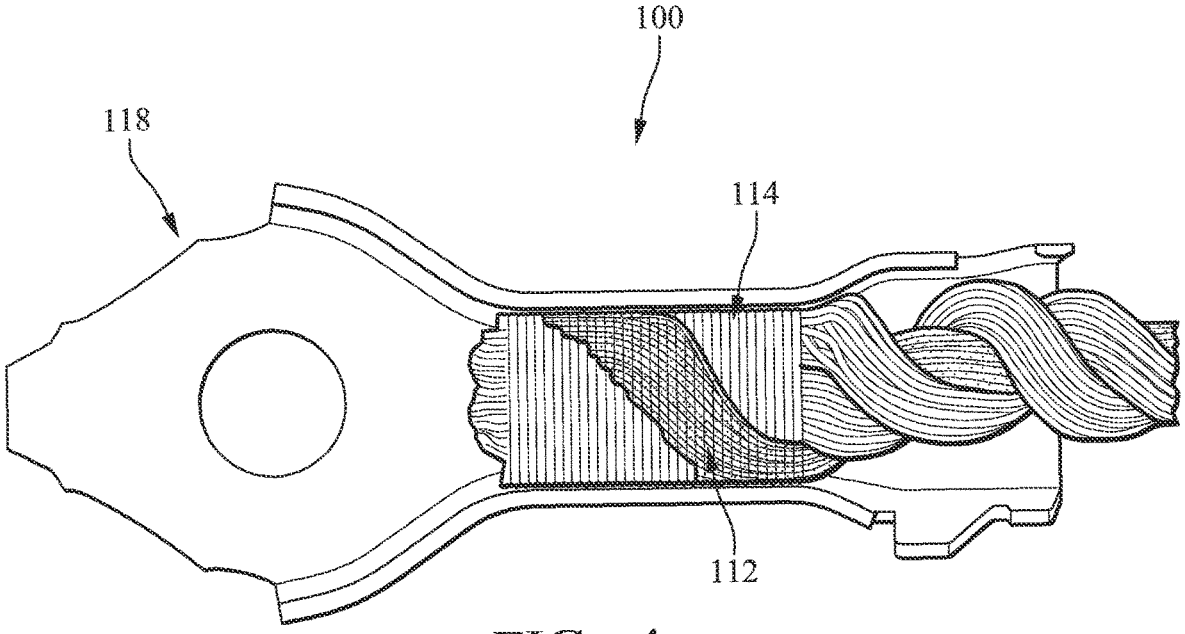
FIG. 4 is a top view of the electrical cable assembly of FIG. 1 attached to an electrical terminal according to some embodiments.

A first non-limiting example of the electrical cable assembly 100 is shown in FIGS. 1-4. This electrical cable assembly has a central strand 110 and three outer wire strands 112 formed of a copper-based alloy and three outer wire strands 114 formed of an aluminum-based alloy. As can be seen in FIGS. 1-3, the aluminum-based outer wire strands 114 are arranged intermediate the copper based outer wire strands 112. The electrical cable assembly may also include an insulative outer jacket 116 as shown in FIG. 1. As shown in FIG. 4, the electrical cable assembly may also include an electrical terminal 118. The wires of the central strand 110 and the outer wire strands 112, 114 are welded to each other and to the electrical terminal 118, preferably by using an ultrasonic welding process, the results of which are shown in FIG. 4.

Figure 5:
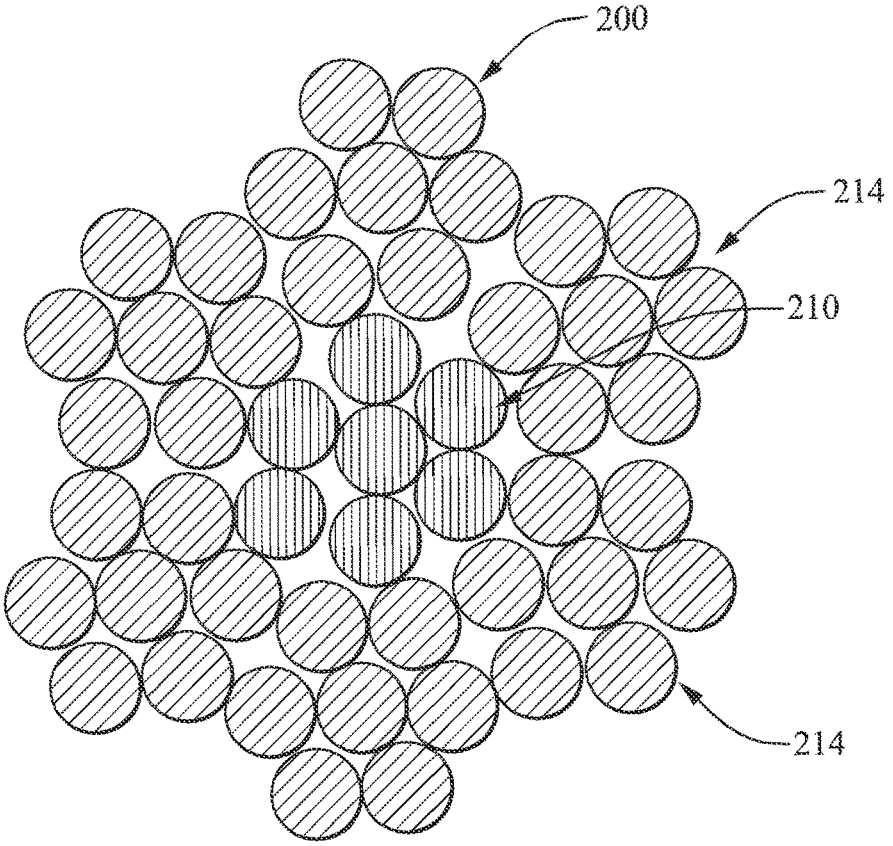
FIG. 5 is an end view of an electrical cable assembly according to some embodiments.
Figure 6:
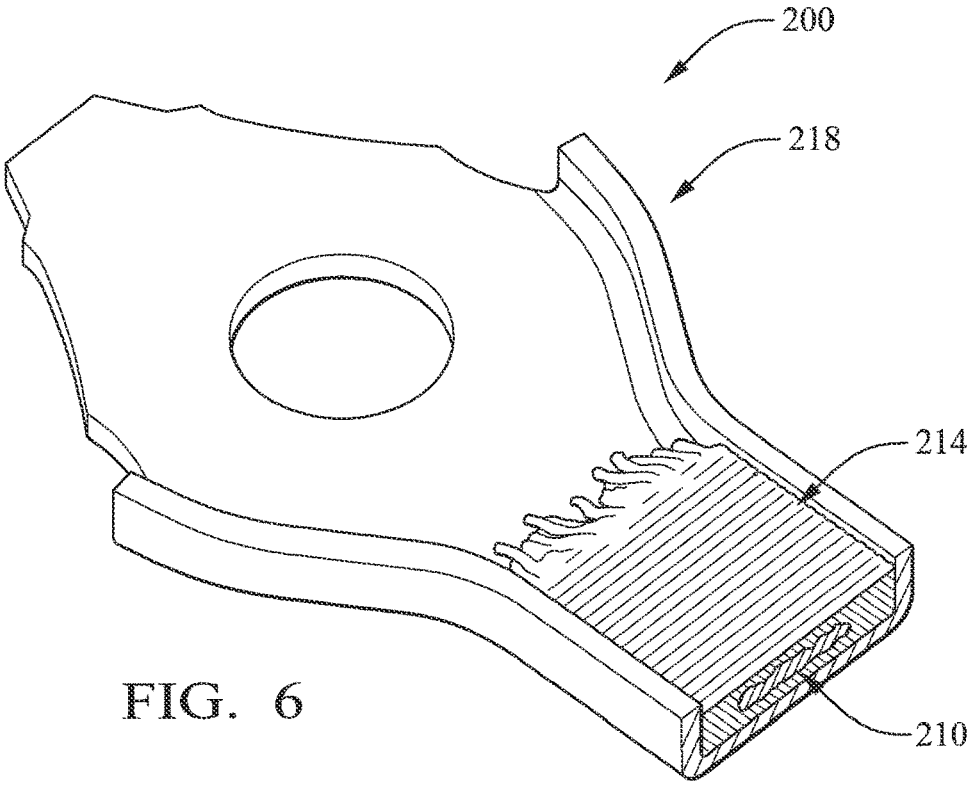
FIG. 6 is a cross section view of the electrical cable assembly of FIG. 5 according to some embodiments.

FIGS. 5 and 6 show a second non-limiting example of the electrical cable assembly 200 having a central strand 210 formed of a copper-based alloy and the outer wire strands 214 formed of an aluminum-based alloy. A cross section view of the central strand 210 and the outer wire strands 214 welded to each other and to an electrical terminal 218 are shown in FIG. 6.

Figure 7:
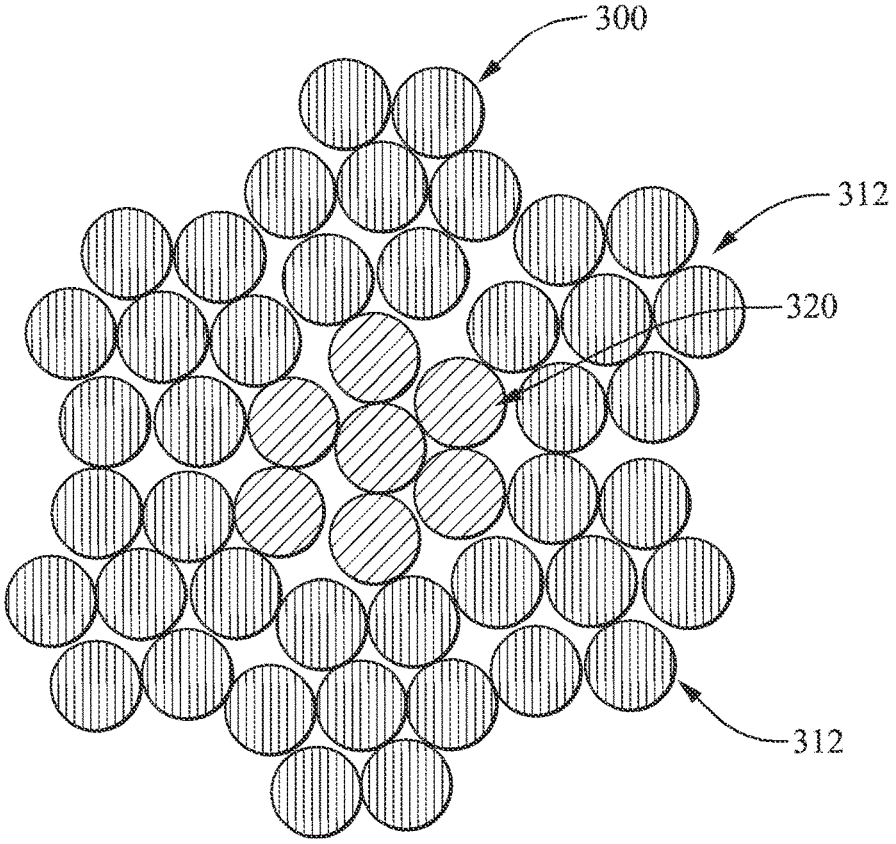
FIG. 7 is an end view of an electrical cable assembly according to some embodiments.
Figure 8:
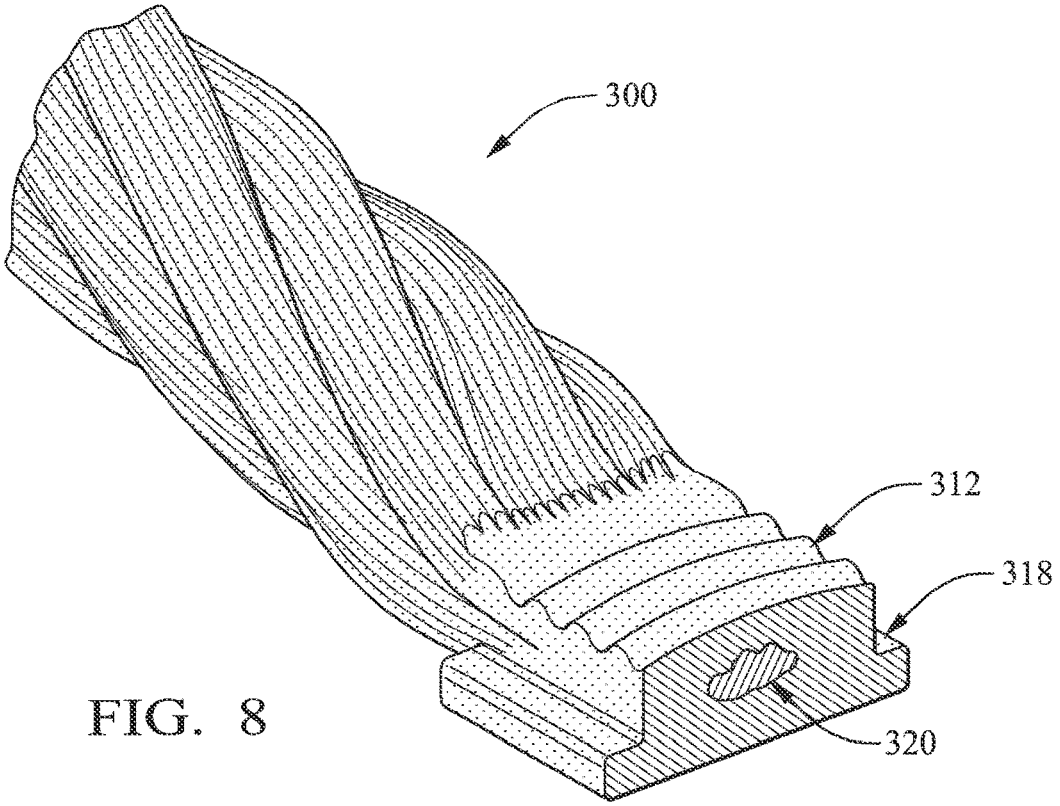
FIG. 8 is a cross section view of the electrical cable assembly of FIG. 7 according to some embodiments.

FIGS. 7 and 8 show a second non-limiting example of the electrical cable assembly 300 having a central strand 320 formed of an aluminum-based alloy and the outer wire strands 312 formed of a copper-based alloy. A cross section view of the central strand 320 and outer wire strands 312 welded to each other and to an electrical terminal 318 are shown in FIG. 8.

The electrical cable assemblies 100, 200, 300 may be disposed within a housing, e.g., a battery case, that protects the electrical cable assemblies 100, 200, 300 from environmental contaminants, e.g., water or salts, that may promote galvanic corrosion between dissimilar metals in the first and second alloys.

Figure 9:
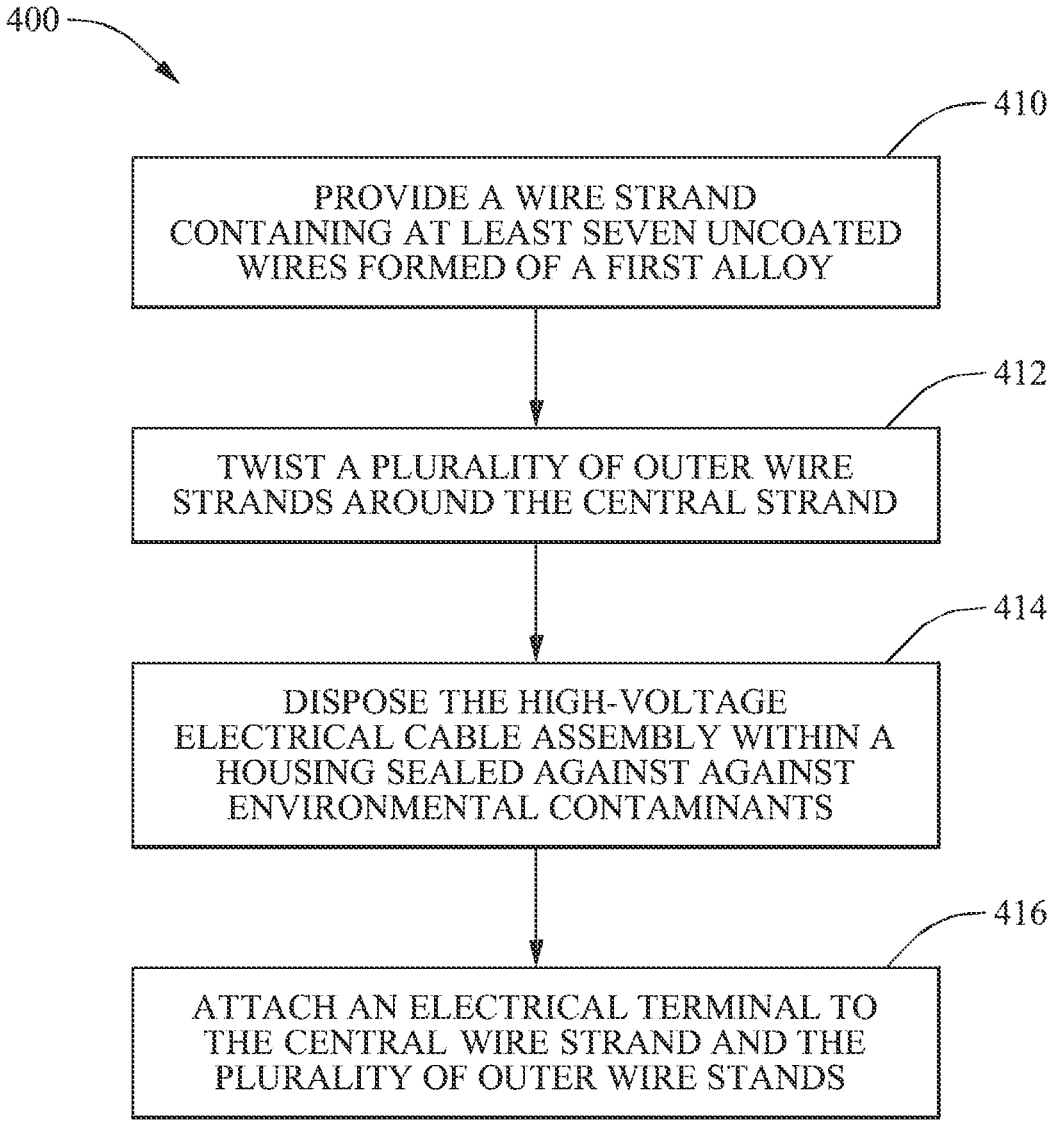
FIG. 9 is a flow chart of a method for assembling a coaxial electrical cable assembly according to some embodiments.

The electrical cable assemblies 100, 200, 300 provide a weight savings over a copper-based conductor with only a slight increase in cross-sectional area. A comparison of weight conductivity, Ω/m, and cross-sectional area equivalence for various electrical cable assembly configurations is shown in FIG. 9.

The inventors have found that the high-voltage electrical cables described herein are easier to ultrasonically weld to terminals since they exhibit less sticking between the welding sonotrode and the cable than conventional aluminum-based conductors.

A method 400 of assembling a high-voltage electrical cable assembly, such as electrical cable assemblies 100, 200, 300, is illustrated in FIG. 10 and described below:

STEP 410, PROVIDE A CENTRAL WIRE STRAND CONTAINING AT LEAST SEVEN WIRES FORMED OF A FIRST ALLOY, includes providing a central wire strand containing at least seven wires formed of a first alloy;

STEP 412, TWIST A PLURALITY OF OUTER WIRE STRANDS AROUND THE CENTRAL STRAND, includes twisting a plurality of outer wire strands around the central strand. At least one outer wire strand of the plurality of outer wire strands contains at least seven wires that are formed of a second alloy different from the first alloy. There is an electrochemical potential of about 2 volts between the first alloy and the second alloy. For example, the first alloy is a copper based alloy and the second alloy is an aluminum based alloy or the first alloy is an aluminum based alloy and the second alloy is a copper based alloy. In electrical cable assembles 200 and 300, the plurality of outer wire strands is formed of the second alloy. In electrical cable assembly 100, a first half of the plurality of outer wire strands is formed of the first alloy and a second half of the plurality of outer wire strands is formed of the second alloy;

STEP 414, DISPOSE THE HIGH-VOLTAGE ELECTRICAL CABLE ASSEMBLY WITHIN A HOUSING SEALED AGAINST ENVIRONMENTAL CONTAMINANTS, includes disposing the high-voltage electrical cable assembly within a housing sealed against environmental contaminants; and STEP 416, ATTACH AN ELECTRICAL TERMINAL TO THE CENTRAL WIRE STRAND AND THE PLURALITY OF OUTER WIRE STRANDS, includes attaching an electrical terminal to the central wire strand and the plurality of outer wire strands. STEP 416 may be performed using an ultrasonic welding process.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

As used herein, 'one or more' includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

Additionally, while terms of ordinance or orientation may be used herein these elements should not be limited by these terms. All terms of ordinance or orientation, unless stated otherwise, are used for purposes distinguishing one element from another, and do not denote any order of arrangement, order of operations, direction or orientation unless stated otherwise.

The invention claimed is:

1. A high-voltage electrical cable assembly, comprising:

a central wire strand formed of a first alloy containing at least seven wires; and a plurality of outer wire strands twisted around the central strand wherein each wire strand of the plurality of outer wire strands is formed of a second alloy and excludes the first alloy, wherein each of the outer wire strands contains at least seven wires, and wherein there is an electrochemical potential of about 2 volts between the first alloy and the second alloy.

2. The high-voltage electrical cable assembly according to claim 1, wherein the first alloy is a copper based alloy and the second alloy is an aluminum based alloy.

3. The high-voltage electrical cable assembly according to claim 1, wherein the first alloy is an aluminum based alloy and the second alloy is a copper based alloy.

4. The high-voltage electrical cable assembly according to claim 1, wherein the at least seven wires formed of the first alloy are uncoated.

5. The high-voltage electrical cable assembly according to claim 1, wherein the at least seven wires formed of the second alloy are uncoated.

6. The high-voltage electrical cable assembly according to claim 1, wherein the high-voltage electrical cable assembly is disposed within a housing sealed against environmental contaminants.

7. The high-voltage electrical cable assembly according to claim 1, further comprising an electrical terminal, wherein the central wire strand and the plurality of outer wire strands are ultrasonically welded to the electrical terminal.

8. The high-voltage electrical cable assembly according to claim 7, wherein the central wire strand and the plurality of outer wire strands are ultrasonically welded to each other.

9. A method of assembling a high-voltage electrical cable assembly, comprising:

providing a central wire strand formed of a first alloy containing at least seven wires; and twisting a plurality of outer wire strands around the central strand, wherein each wire strand of the plurality of outer wire strands is formed of a second alloy and excludes the first alloy, wherein each of the outer wire strands contains at least seven wires, and wherein there is an electrochemical potential of about 2 volts between the first alloy and the second alloy.

10. The method according to claim 9, wherein the first alloy is a copper based alloy and the second alloy is an aluminum based alloy.

11. The method according to claim 9, wherein the first alloy is an aluminum based alloy and the second alloy is a copper based alloy.

12. The method according to claim 9, further comprising disposing the high-voltage electrical cable assembly within a housing sealed against environmental contaminants.

13. The method according to claim 9, further comprising attaching an electrical terminal to the central wire strand and the plurality of outer wire strands.

14. The method according to claim 13, wherein the step of attaching the electrical terminal to the central wire strand and the plurality of outer wire strands is performed using an ultrasonic welding process.

15. The method according to claim 13, further comprising welding the central wire strand and the plurality of outer wire strands to each other.

16. The method according to claim 15, wherein the step of welding the central wire strand and the plurality of outer wire strands to each other is performed using an ultrasonic welding process.

* * * * *